US009616688B2

(12) United States Patent
Murotani et al.

(10) Patent No.: US 9,616,688 B2
(45) Date of Patent: Apr. 11, 2017

(54) TRANSPORT DEVICE AND PRINTING APPARATUS

(71) Applicant: SEIKO EPSON CORPORATION, Tokyo (JP)

(72) Inventors: Tomoya Murotani, Shiojiri (JP); Takahiro Abe, Shiojiri (JP); Hiroyuki Kobayashi, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/171,954

(22) Filed: Jun. 2, 2016

(65) Prior Publication Data

US 2016/0355036 A1 Dec. 8, 2016

(30) Foreign Application Priority Data

Jun. 4, 2015 (JP) ..... 2015-114280

(51) Int. Cl.

| | |
|---|---|
| ***B41J 29/393*** | (2006.01) |
| ***B41J 11/46*** | (2006.01) |
| ***B41J 15/00*** | (2006.01) |
| ***B41J 13/00*** | (2006.01) |

(52) U.S. Cl.

CPC ..... *B41J 13/0009* (2013.01)

(58) Field of Classification Search

CPC ..... B41J 11/42; B41J 11/46; B41J 13/0009; B41J 15/00; B41J 15/046; B41J 29/38; B41J 29/393

See application file for complete search history.

(56) References Cited

U.S. PATENT DOCUMENTS

2010/0129129 A1* 5/2010 Katayama ..... B41J 11/008 400/582
2014/0125729 A1* 5/2014 Abe ..... B41J 11/0095 347/19

FOREIGN PATENT DOCUMENTS

JP 2011-201152 10/2011
JP 2011201152 A * 10/2011

OTHER PUBLICATIONS

Abe, Takahiro, MachineTranslationofJP 2011201152 A, 2011.*

* cited by examiner

*Primary Examiner* — Geoffrey Mruk
*Assistant Examiner* — Scott A Richmond
(74) *Attorney, Agent, or Firm* — Workman Nydegger

(57) ABSTRACT

A printing apparatus includes a control unit that calculates a transport amount (an actual transport amount) during a transport period based on a captured image of a medium by an imaging unit and controls a transport unit. In addition, the control unit calculates the transport amount (the actual transport amount) during the transport period by calculating the transport amount at each calculation interval (a divided transport amount) and integrating the transport amount at each calculation interval (the divided transport amount). Then, the control unit causes the calculation interval to be longer in a case where the transporting speed of the medium is low than in a case where the transporting speed of the medium is high.

10 Claims, 10 Drawing Sheets

FIG. 8A TRANSPORT SPEED Vf

FIG. 8B TRANSPORT AMOUNT

FIG. 8C IMAGING TIMING

FIG. 8D CALCULATION TIMING

TRANSPORT DEVICE AND PRINTING APPARATUS

BACKGROUND

1. Technical Field

The present invention relates to a transport device transporting a medium such as paper and a printing apparatus including the transport device.

2. Related Art

Hitherto, printing apparatuses that print characters or images by discharging ink on a medium which is intermittently transported by a transport unit have been known. Among these printing apparatuses, there is a printing apparatus which includes an imaging unit that images a medium which is transported by a transport unit at each imaging interval, and a control unit that calculates a transport amount of the mediums based on an image which is captured by the imaging unit and controls the transport unit based on the transport amount (for example, JP-A-2011-201152).

Specifically, such a printing apparatus provides feedback on an actual transport amount which is an amount that the medium is actually transported and is calculated based on the image captured by the imaging unit as a controlled transport amount until the transport of the medium is stopped. In this manner, the transport error of the printing apparatus is decreased. The actual transport amount is calculated by integrating the transport amount of the medium at each imaging interval which is calculated based on the image captured at each imaging interval.

However, the printing apparatus described above intermittently transports the mediums. Therefore, a transport period, during which the medium is transported, of the printing apparatus includes a period in which the transport speed is low such as a period immediately after the start of the transport of the medium or a period immediately before the termination of the transport of the mediums, and a period in which the transport is high such as a period during which the medium is transported at a constant speed. In this case, the number of calculations of the transport amount per unit transport amount is likely to be more increased during the period in which the transport speed is low than during the period in which the transport speed is high by the difference between the transport speeds of the medium.

The transport amount at each imaging interval is calculated according to a moved amount of an area including a characteristic pattern in the previous image by specifying which area in the current image the area is moved to. As such, since the transport amount at each imaging interval is calculated based on the image formed of a finite number of pixels, this calculation includes a calculation error due to the quantization in the transport amount at each imaging interval.

Therefore, in a case where the transport amount calculated at each imaging interval is integrated and the actual transport amount during the transport period is calculated, the number of calculations of the transport amount during the period in which the transport speed is low among the transport periods is likely to be increased and the calculation error in accordance with the increase of the number of calculations may affect the calculation accuracy of the actual transport amount.

The above actual circumstances are not limited to the printing apparatus and is substantially common in a transport device which intermittently transports the medium.

SUMMARY

An advantage of some aspects of the invention is to provide a transport device which prevents the calculation accuracy of the transport amount of the medium from being reduced during the transport period from the start of the medium transport to the termination of the medium transport, and a printing apparatus including the transport device.

Hereinafter, means of the invention and operation effects thereof will be described.

According to an aspect of the invention, there is provided a transport device including a transport unit that intermittently transports a medium; an imaging unit that images the medium transported by the transport unit; and a control unit that calculates a transport amount during a transport period from start of the medium transport to stop of the medium transport based on a captured image of the medium by the imaging unit and controls the transport unit. The control unit calculates the transport amount during the transport period by calculating a divided transport amount at each divided period which is obtained by dividing the transport period into a plurality of periods and integrating the divided transport amounts at each divided period. Then, the control unit causes the divided period to be longer in a case where a transport speed of the medium is low than in a case where the transport speed of the medium is high.

In a case where the medium is intermittently transported, since the medium is calculated or decelerated, the transport speed of the medium is changed during the transport period from when the transport of the medium is started to when the transport of the medium is stopped. Then, when a divided transport amount by setting a divided period to be an equal interval is calculated, the divided transport amount is smaller in a case where the transport speed of the medium is low than in a case where the transport speed of the medium is high. Therefore, the number of calculations of the divided transport amount is likely to be more increased in a case where the transport speed of the medium is low than in a case where the transport speed of the medium is high. Accordingly, the calculation accuracy of the transport amount during the transport period which is calculated by integrating the divided transport amount at each divided period is likely to be reduced.

At this point, according to the configuration described above, the divided period is longer in a case where the transport speed of the medium is low than in a case where the transport speed of the medium is high. For this reason, the divided transport amount is more increased in a case where the transport speed of the medium is low than in a case where the divided period is set to be an equal interval. Therefore, the number of the calculations of the divided transport amount is decreased. According to the configuration, it is possible to prevent the calculation accuracy of the transport amount during the transport period from being reduced.

Here, in the transport device, it is preferable that the transport period includes a first period including an acceleration period during which the medium is transported while accelerating the medium, a second period following the first period, and a third period following the second period and including a deceleration period during which the medium is transported while decelerating the medium. The control unit may cause the divided period during at least one period of the first period and the third period to be longer than that during the second period.

Since the first period includes the acceleration period, the transport speed of the medium during the first period is likely to be lower than the transport speed of the medium during the second period. In addition, since the third period includes the deceleration period, the transport speed of the medium during the third period is likely to be lower than the transport speed of the medium during the second period. For this reason, according to the configuration, by causing the divided period during at least one period of the first period and the third period to be longer than that during the second period, even though the control unit does not grasp the transport speed of the medium, it is possible to increase the divided period as the transport speed of the medium is decreased. Therefore, according to the configuration, since the control unit may not grasp the transport speed of the medium, it is possible to prevent the control configuration from being complicated.

In addition, in the transport device, it is preferable that the transport period includes a deceleration period during which the medium is transported while decelerating the medium, the deceleration period includes a first deceleration period, and a second deceleration period which follows the first deceleration period and is terminated at a timing when the medium is stopped, and the control unit causes the divided period during the second deceleration period to be shorter than that during the first deceleration period.

According to the configuration described above, the second deceleration period includes a period immediately before the medium is stopped. In addition, since the divided period during the second deceleration period is shorter than the divided period during the first deceleration period, it is possible to calculate the divided transport amount during the period immediately before the transport of the medium is stopped in detail. On the other hand, when the divided period during the first deceleration period in addition to the second deceleration period is decreased, the number of the calculations of the divided transport amount during the first deceleration period is increased. Therefore, the calculation accuracy of the transport amount during the transport period is likely to be reduced. Therefore, according to the configuration, it is possible to calculate the divided transport amount immediately before the transport of the medium is stopped in detail while preventing the calculation accuracy from being reduced.

Further, in the transport device, it is preferable that the control unit causes the divided period to be longer in a case where the transport speed is low than in a case where the transport speed is high by increasing an imaging interval of the imaging unit.

According to the configuration described above, the imaging interval is longer in a case where the transport speed is low than in a case where the transport speed is high. As a result, the divided period is increased. Therefore, the imaging interval when the imaging unit images the medium is changed, and thus it is possible to prevent the calculation accuracy of the transport amount during the transport period from being reduced.

Further, in the transport device, it is preferable that the imaging unit images the medium at an equal imaging interval, and the control unit causes the divided period to be longer in a case where the transport speed is low than in a case where the transport speed is high, by, among two images used when the divided transport amount is calculated, selecting the other image so that the period elapsed from when one image is captured to when the other image is captured is increased.

In a case where the transport interval is not changed according to the transport speed of the medium, the imaging unit images the medium at an equal interval. In this case, it is preferable that the other image is selected among the two images used when the divided transport amount is calculated, in order to increase the period elapsed from when the one image is captured to when the other image is captured more in a case where the transport speed is low than in a case where the transport speed is high.

According to the configuration, in a case where the transport speed is low, by causing a portion of the image captured by the imaging unit not to be used in the calculation of the divided transport amount, the divided period is increased. Therefore, it is possible to decrease the number of the calculations of the divided transport amount. According to the configuration, it is possible to prevent the calculation accuracy of the transport amount during the transport period from being reduced, while preventing the control configuration from being complicated since there is no need to perform control for changing the imaging interval of the imaging unit.

According to another aspect of the invention, there is provided a printing apparatus including a transport device that transports a medium; and a printing unit that prints on the medium which is transported by the transport device in which the printing apparatus includes the transport device described above.

In this configuration, in the printing apparatus, it is possible to obtain the advantageous effects achieved by the above-described transport device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a transport device and a printing apparatus including the transport device of the invention will be described in detail with reference to the drawings. The printing apparatus of the embodiment is an ink jet type of a large-format printer which forms characters or images by ejecting ink onto an elongated medium.

Figure 1:
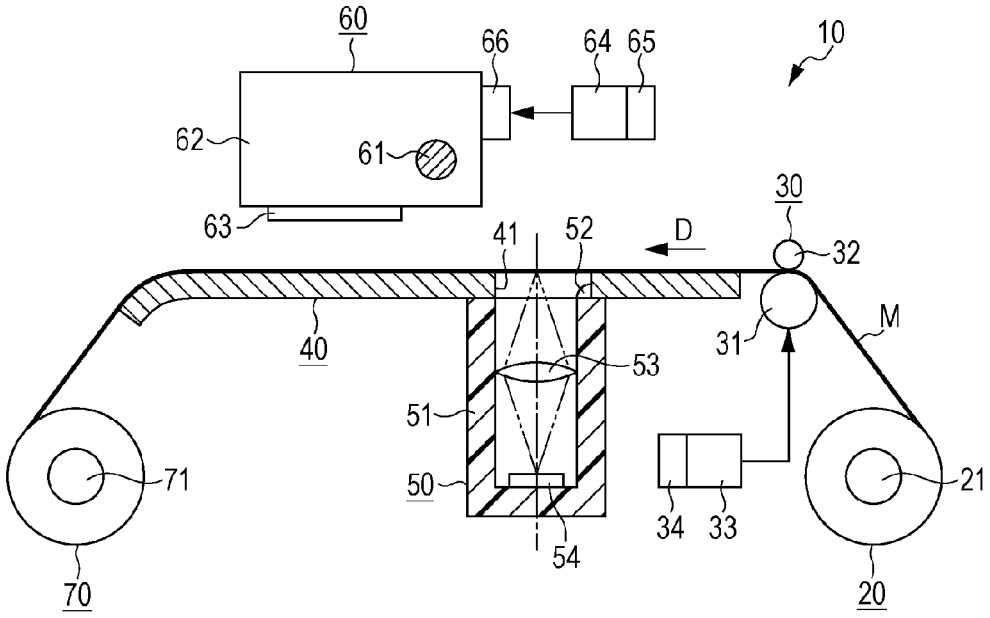
FIG. 1 is a side view illustrating a schematic configuration of a printing apparatus.

As illustrated in FIG. 1, a printing apparatus 10 includes a feeding unit 20 that feeds a medium M along a transporting direction D of the medium M, a transport unit 30 that transports the medium M, a supporting unit 40 that supports the medium M, an imaging unit 50 that images the medium M, a printing unit 60 that prints on the medium M, and a winding unit 70 that winds the medium M.

The feeding unit 20 holds a roll body 21 that winds the medium M into a roll. The feeding unit 20 performs feeding of the medium M unwound from the roll body 21 by rotating the roll body 21 in one direction (counterclockwise in FIG. 1).

The transport unit 30 includes a transport roller 31 that is in contact with a rear surface of the medium M, a driven roller 32 that is in contact with a front surface of the medium M, a transport motor 33 that drives the transport roller 31, and a rotary encoder 34 that detects a rotation amount of a rotation shaft of the transport motor 33. The transport unit 30 intermittently transports the medium M in the transport direction D by the transport motor 33 being driven or stopped in a state in which the medium M is sandwiched between the transport roller 31 and the driven roller 32.

The supporting unit 40 has a plate-shape so as to be capable of being in contact with the rear surface of the medium M and supporting the medium M. The supporting unit 40 is provided to be opposite to the printing unit 60. The supporting unit 40 has an opening section 41 formed therethrough in a direction intersecting (orthogonal to) the transport direction D of the medium M. The opening section 41 is formed at a position where the opening section is occluded by the medium M at the time of transporting the medium M in the supporting unit 40.

The imaging unit 50 includes a cylindrical barrel 51 that extends in a penetration direction of the opening section 41 of the supporting unit 40, an irradiation unit 52 that radiates light, a lens 53 that collects light, and an imaging element 54 that converts the received light into image data. The barrel 51 is connected to the supporting unit 40 so as to occlude the opening section 41 of the supporting unit 40 from the lower portion in a vertical direction. The irradiation unit 52 is provided on the top portion in the longitudinal direction of the cylindrical barrel 51. The lens 53 is provided on the central portion in the longitudinal direction of the cylindrical barrel 51. The imaging element 54 is provided on the bottom portion in the longitudinal direction of the cylindrical barrel 51. It is desired that the cylindrical barrel 51 is formed of a material having low optical transmittance and low optical reflectivity such as black resin material, for example.

The imaging unit 50 irradiates the rear surface of the medium M supported by the supporting unit 40 with light from the irradiation unit 52. Then, the light reflected from the rear surface of the medium M is collected at the lens 53 and is received in the imaging element 54. Thus, the imaging unit 50 causes the imaging element 54 to image an image of the rear surface of the medium M which is a subject.

The printing unit 60 includes a guide shaft 61 having a width direction (a direction perpendicular to the paper surface in FIG. 1) as a longitudinal direction, a carriage 62 that is supported by the guide shaft 61, and a discharging head 63 that discharges ink from a nozzle (not shown) on the medium M. The printing unit 60 includes a carriage motor 64, a rotary encoder 65 that detects a rotation amount of the rotation shaft of the carriage motor 64, and a transmission mechanism 66 that converts the rotation motion of the rotation shaft of the carriage motor 64 into linear motion in the width direction of the carriage 62.

The discharging head 63 is provided in a portion in the carriage 62 that is opposite to the supporting unit 40 and discharges ink toward the medium M supported by the supporting unit 40. The transmission mechanism 66 may include a pair of pulleys and belts wrapping around the pair of pulleys, for example. The printing unit 60 allows ink to be discharged from the discharging head 63 supported by the carriage 62, while allowing the carriage 62 to reciprocate in the width direction.

The winding unit 70 holds a roll body 71 for winding the medium M into a roll. The winding unit 70 winds the printed medium M by rotating the roll body 71 in one direction (the counterclockwise in FIG. 1).

Next, with reference to FIG. 2, an electric configuration of the printing apparatus 10 will be described.

Figure 2:
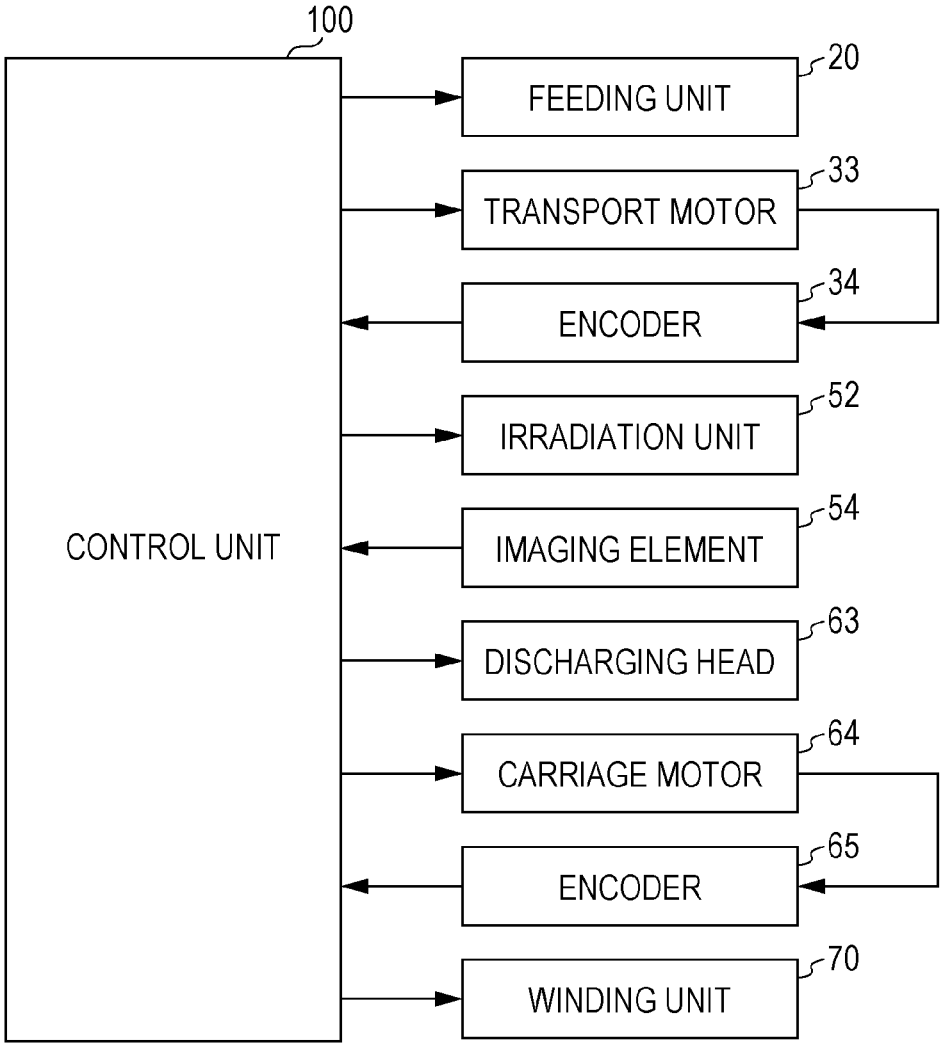
FIG. 2 is a block diagram illustrating an electric configuration of the printing apparatus.

As illustrated in FIG. 2, the printing apparatus 10 includes a control unit 100 that integrally controls the printing apparatus. The control unit 100 includes a CPU, a ROM, a RAM, and the like. In addition, an input side interface of the control unit 100 is connected with the rotary encoders 34 and 65 and the imaging element 54, and an output side interface of the control unit 100 is connected with the feeding unit 20, the transport motor 33, the irradiation unit 52, the discharging head 63, the carriage motor 64, and the winding unit 70.

The printer of the embodiment is referred to as a serial printer. According to this, the control unit 100 alternatively performs a transport operation in which the medium M is transported by a predetermined amount by drive of the transport motor 33 and a discharging operation in which the carriage 62 reciprocates in the width direction of the medium M by drive of the carriage motor 64 and ink is discharged from the discharging head 63 which is supported by the carriage 62.

The control unit 100 calculates the transport amount of the medium M in the transport operation based on the image which is captured by the imaging unit 50 during the transport operation and controls the drive of the transport unit 30 (the transport motor 33) in the next transport operation based on the transport amount. At this point, in this embodiment, an example of "the transport device" includes the transport unit 30, the supporting unit 40, the imaging unit 50, and the control unit 100.

Next, with reference to FIGS. 3A and 3B, an example of the transport operation when the printing apparatus 10 according to the present embodiment performs printing on the medium M will be described.

Figures 3A, 3B:
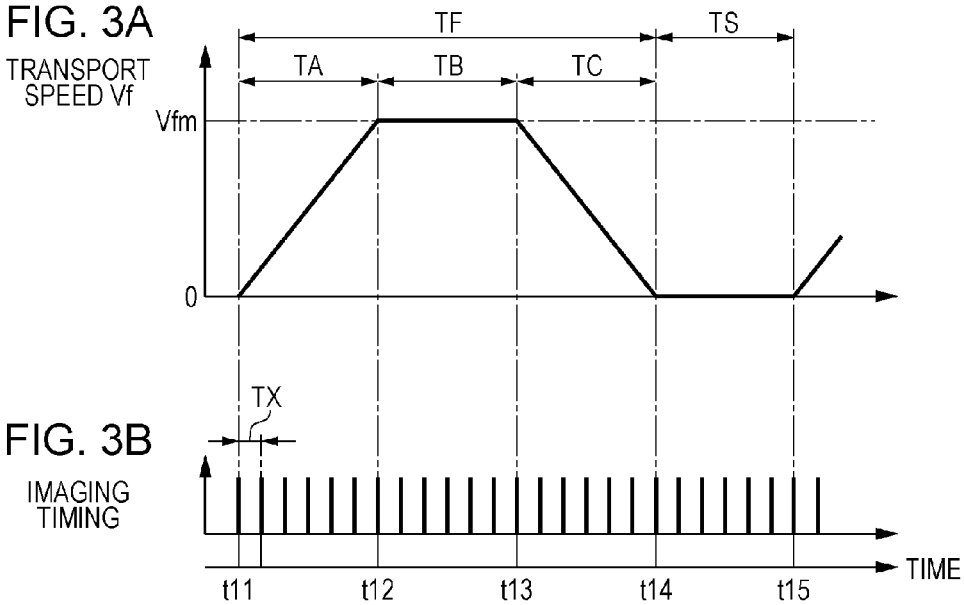
FIG. 3A is a timing chart illustrating transition of a transport speed and FIG. 3B is a timing chart illustrating transition of an imaging timing on the medium, when performing printing on a medium.

As illustrated in FIG. 3A, at a first timing t11, the drive of the transport motor 33 is started and thus the transport operation is started. Then, after the first timing t11, the rotation speed of the transport motor 33 is gradually increased so that a transport speed Vf is gradually increased. Subsequently, at a second timing t12 in which the transport speed Vf becomes the highest speed Vfm, the rotation speed of the transport motor 33 is maintained. In other words, the transport speed Vf is maintained at the highest speed Vfm after the second timing t12. After this, at a third timing t13, in order to stop the transport of the medium M, the rotation speed of the transport motor 33 starts to be decreased. According to this, after the third timing t13, the transport speed Vf is gradually decreased.

Subsequently, at a fourth timing t14, the rotation speed of the transport motor 33 is set to "0 (zero)", and then the transport of the medium M is stopped. Additionally, during the period from the fourth timing t14 to a fifth timing t15, the discharging operation is performed. After this, at the fifth timing t15 in which the discharging operation is terminated, similar to the first timing t11, the drive of the transport motor 33 is started, and thus the next transport operation is started.

The period from the first timing t11 to the second timing t12 is an acceleration period TA in which the transport speed Vf is gradually increased. In addition, the period from the second timing t12 to the third timing t13 is a constant speed period TB in which the transport speed Vf is set to a constant speed. Also, the period from the third timing t13 to the fourth timing t14 is a deceleration period TC in which the transport speed Vf is gradually decreased.

The period from the fourth timing t14 to the fifth timing t15 in which the discharging operation is performed is a stopping period TS in which the transport of the medium M is stopped. In addition, in the embodiment, the period that includes the acceleration period TA, the constant speed period TB and the deceleration period TC, that is, the period from the start to the stop of the transport of the medium M is referred to as a transport period TF.

Accordingly, in a case where the printing is performed on the medium M in the printing apparatus 10, the transport period TF and the stopping period TS are alternatively repeated. In other words, in the printing apparatus 10, the medium M is intermittently transported and the printing is performed by discharging ink toward the medium M when the transport of the medium M is stopped.

As illustrated in FIG. 3B, the imaging of the medium M is performed at each imaging interval TX by the imaging unit 50 in the transport period TF and the stopping period TS. Accordingly, the transport amount during the transport period TF is calculated based on the image captured by the imaging unit 50. The transport amount during the transport period TF is used to determine transport error by comparison with the transport amount of the medium M that was attempted to be transported during the transport period TF. The imaging interval TX is a time interval and is set to an equal interval in the present embodiment.

Figure 4A:
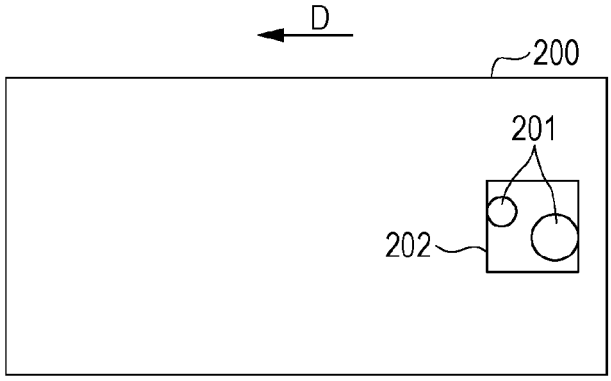
FIGS. 4A, 4B, and 4C are schematic diagrams illustrating an image of the medium captured by the imaging unit.

Next, with reference to FIGS. 4A, 4B, and 4C, a calculation method of the transport amount of the medium M during the transport period TF will be described based on the image 200 of the medium M that is captured by the imaging unit 50. In the following description, among the two images 200 used when the transport amount is calculated, the image 200 captured earlier is referred to as "a previous image" and the image 200 captured later is referred to as "a current image". FIG. 4A is a view illustrating an example of the previous image, FIG. 4B is a view illustrating an example of the current image, and FIG. 4C is a view illustrating an example of another current image.

In the embodiment, the transport amount during the transport period TF is calculated by pattern matching of the local area of the two images 200 that are captured by the imaging unit 50. The pattern matching is performed by searching which area in the current image illustrated in FIG. 4B the pattern 201 appearing on the end portion of the upstream side in the transport direction D of the previous image illustrated in FIG. 4A is located. In other words, the pattern matching is performed by calculation of similarity of the pattern 201 cut from the previous image and the pattern 201 cut from the current image using a window 202 having a smaller size than the captured image 200.

Specifically, the similarity of the pattern 201 cut using the window 202 and the pattern 201 cut from the previous image using the window 202 is calculated while moving the window 202 pixel by pixel from the upstream side toward the downstream side in the transport direction D within the current image. Furthermore, the similarity is stored corresponding to the position of the window 202 within the current image, and the position having the highest similarity within the current image is set to a position at which the pattern 201 cut from the previous image using the window 202 is moved.

Figure 4B:
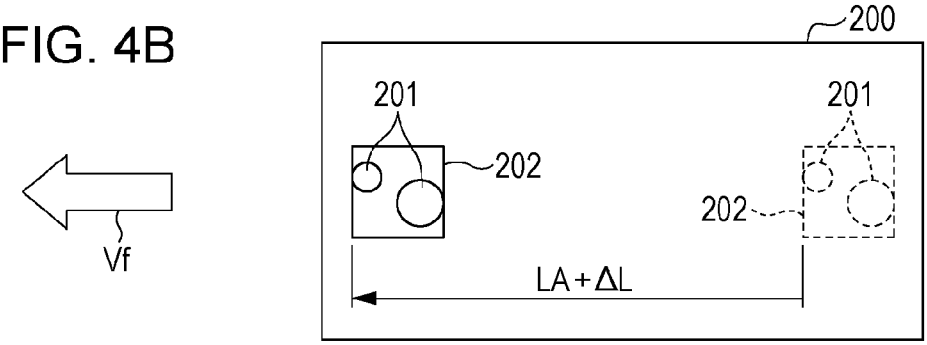
Figure 4C:
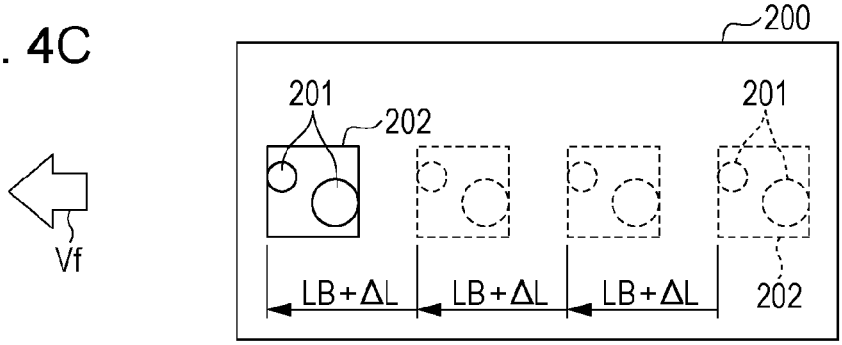

In other words, as illustrated in FIG. 4B, a distance LA in the transport direction D from the position of the window 202 within the previous image to the position of the window 202 of having the highest similarity within the current image is set to the transport amount of the medium M during a period from capturing of the previous image to capturing of the current image. The calculated transport amount is integrated from the transport start and then the transport amount during the transport period TF is calculated.

In the following description, the transport amount during the divided period from the transport period TF which is calculated based on the previous image and the current image is referred to as "divided transport amount Fs", and the transport amount during the transport period TF calculated by integrating the divided transport amount Fs is referred to as "actual transport amount Fr".

Meanwhile, since the divided transport amount Fs is calculated based on the image 200 formed of a finite number of pixels in actual, the divided transport amount Fs includes an error (hereinafter, referred to as "calculation error" in order to distinguish from the transport error) according to pixel density. In other words, when the divided transport amount Fs is calculated based on the two images 200, the calculation error is generated since the transport amount of which the size is less than the pixel configuring the image 200 is not accurately calculated. In the current image, even though the transport amount of which the size is less than the pixel is calculated by an interpolating method based on the size of similarity of the neighboring pixel, the calculation error is still generated.

On the other hand, as illustrated in FIG. 3A, in the case where the transport speed Vf is relatively low such as the acceleration period TA and the deceleration period TC, as illustrated in FIG. 4C, the divided transport amount Fs (=distance LB) becomes small. Therefore, in a state where the time interval at which the divided transport amount Fs is calculated is set to be an equal interval, the number of calculations of the divided transport amount Fs per unit transport amount is likely to be more increased in a case where the transport speed Vf is low than in a case where the transport speed Vf is high. As a result, the number of calculations of the divided transport amount Fs during the period in which the transport speed Vf is low is increased, and the calculation accuracy of the actual transport amount Fr which is calculated by integrating the divided transport amount Fs may be reduced.

For example, as illustrated in FIG. 4B, in a case where the transport speed Vf is high, in order to calculate the transport amount of the distance LA, one calculation of the divided transport amount Fs may be performed, and by contrast, as illustrated in FIG. 4C, in a case where the transport speed Vf is low, in order to calculate the transport amount of the distance LA (=3·LB), it is required that three calculations of the divided transport amount Fs are performed. Therefore, when the calculation error ΔL is generated by one calculation of the divided transport amount Fs, the calculation error (3·ΔL) which is generated when the transport amount of the distance LA is calculated in a case where the transport speed Vf is low, as illustrated in FIG. 4C, is higher than the calculation error (ΔL) which is generated when the transport amount of the distance LA is calculated in a case where the transport speed Vf is high, as illustrated in FIG. 4B.

Therefore, in this embodiment, when the time interval at which the divided transport amount Fs is calculated is set to a "calculation interval TY", the calculation interval TY is longer in a case where the transport speed Vf is low than in a case where the transport speed Vf is high. In this case, the calculation interval TY is an example of "the divided period" formed by dividing the transport period TF into a plurality of the periods.

Specifically, the calculation interval TY is longer in a case where the transport speed Vf is low than in a case where the transport speed Vf is high, by, among the two images 200 used when the divided transport amount Fs is calculated, selecting the other image 200 so that the period elapsed from when the one image 200 is captured to when the other image of 200 is captured is increased.

However, as a result of an increase of the calculation interval TY, since more medium M during the period from when the previous image is captured to when the current image is captured is transported, the pattern 201 cut from the previous image using the window 202 is surely included in the current image. In other words, it is desired that an upper limit value of the calculation interval TY is set in advance according to the transport speed Vf of the medium M.

In addition, it is desired that the calculation interval TY is short in order to accurately calculate the actual transport amount Fr immediately before the transport of the medium M is stopped. Therefore, in this embodiment, when the deceleration period TC includes a first deceleration period TC1 and a second deceleration period TC2 which follows the first deceleration period TC1 and is terminated at a timing when the medium M is stopped, the calculation interval TY in the second deceleration period TC2 is shorter than the calculation interval TY in the first deceleration period TC1.

Figure 5:
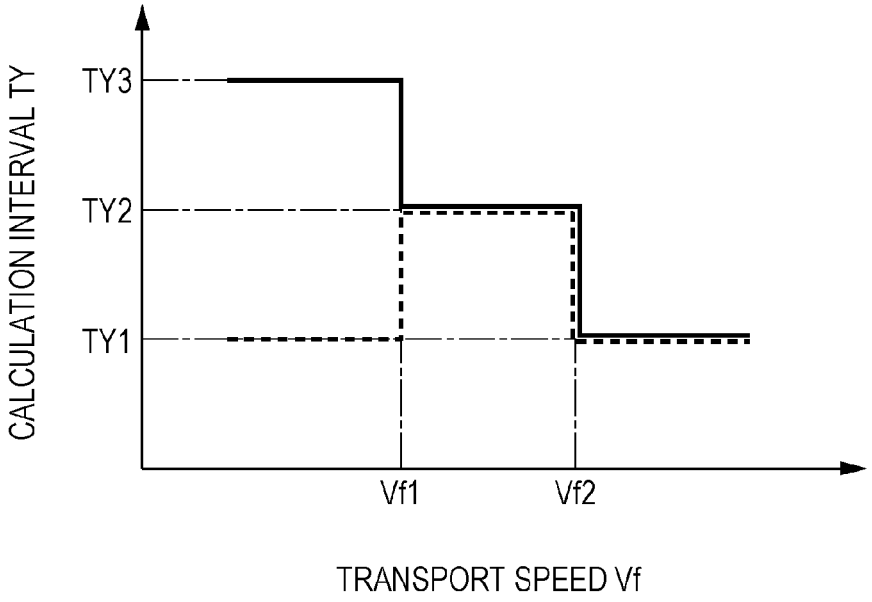
FIG. 5 is a view illustrating a map for determining a calculation interval according to the transport speed.

Next, with reference to FIG. 5, a map for changing the calculation interval TY will be described according to the transport speed Vf. In FIG. 5, the maps in the acceleration period TA and in the constant speed period TB are illustrated by a solid line and the map in the deceleration period TC is illustrated by a broken line.

As illustrated by the solid line in FIG. 5, in the acceleration period TA and the constant speed period TB, the calculation interval TY is set to the third calculation interval TY3, in a case where the transport speed Vf is less than a first determination speed Vf1. The calculation interval TY is set to the second calculation interval TY2 which is shorter than the third calculation interval TY3, in a case where the transport speed Vf is greater than or equal to the first determination speed Vf1 and is less than the second determination speed Vf2 larger than the first determination speed Vf1. In a case where the transport speed Vf is greater than or equal to the second determination speed Vf2, the calculation interval TY is set to the first calculation interval TY1 which is shorter than the second calculation interval TY2. Accordingly, in the acceleration period TA and the constant speed period TB, the calculation interval TY is increased as the transport speed Vf becomes low.

As illustrated by the broken line in FIG. 5, in the deceleration period TC, the calculation interval TY is set to the first calculation interval TY1 in a case where the transport speed Vf is less than the first determination speed Vf1 and in a case where the transport speed Vf is greater than or equal to the second determination speed Vf2. The calculation interval TY is set to the second calculation interval TY2 in a case where the transport speed Vf is greater than or equal to the first determination speed Vf1 and is less than the second determination speed Vf2. Thus, in the deceleration period TC, the calculation interval TY is increased as the transport speed Vf becomes low in a case where the transport speed Vf is greater than or equal to the first determination speed Vf1. In the deceleration period TC, the calculation interval TY is decreased in a case where the transport speed Vf is less than the first determination speed Vf1, that is, at least immediately before the transport of the medium M is stopped.

Next, with reference to flow charts in FIGS. 6 and 7, when printing on the medium M, a processing routine that the control unit 100 performs will be described. The present processing routine is a processing routine that is performed each time a print job is input in the printing apparatus 10.

Figure 6:
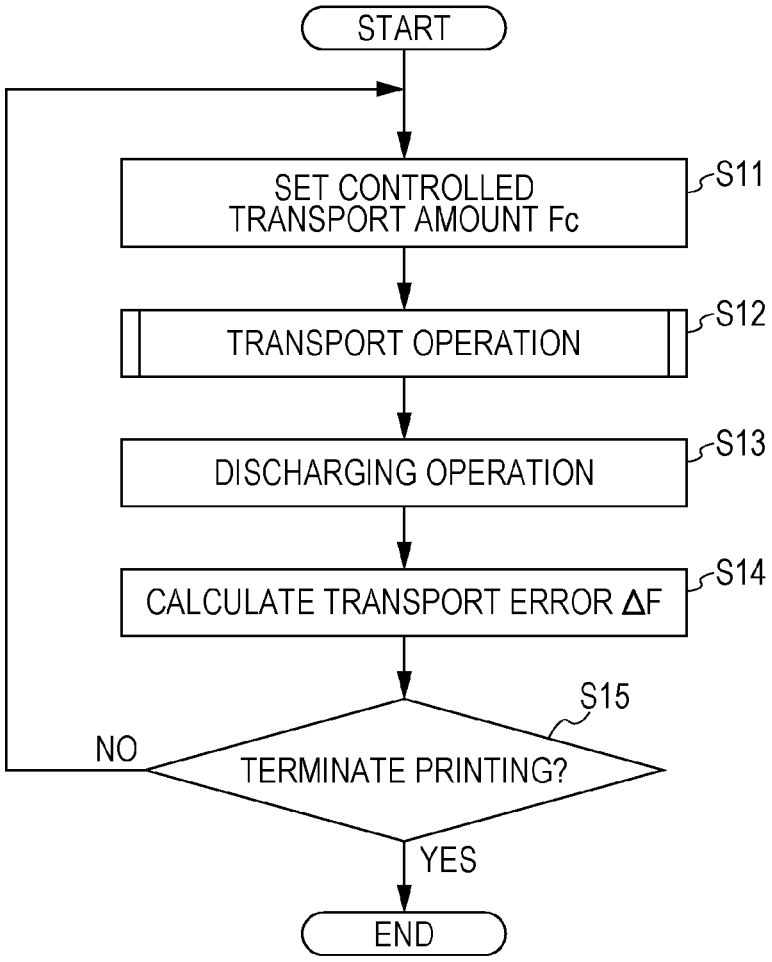
FIG. 6 is a flow chart illustrating a processing routine performed by the control unit in order to perform printing on a medium.

As illustrated in FIG. 6, in the present processing routine, the control unit 100 sets the controlled transport amount Fc based on the target transport amount Ft which is a target value of the transport amount during the transport period TF (step S11) and performs the processing for the transport operation (step S12). Here, the controlled transport amount Fc is a control variable which is used when the drive of the transport motor 33 is controlled, and in a case where the transport error ΔF is not generated, the controlled transport amount is equal to the target transport amount Ft. In addition, the transport error ΔF is calculated by subtracting the actual transport amount Fr from the target transport amount Ft.

Then, the control unit 100 performs processing for performing the discharging operation (step S13), and causes ink to be discharged from the discharging head 63 on the medium M which is transported by the transport operation. Subsequently, the control unit 100 sets a difference obtained by subtracting the actual transport amount Fr which is calculated by performing of step S12 from the target transport amount Ft as the transport error ΔF (step S14). Then, the control unit 100 determines whether all the printing is terminated or not (step S15), and in the case where all the printing is terminated (step S15: YES), the present processing routine is temporarily terminated.

On the other hand, in the case where all the printing is not terminated (step S15: NO), the control unit 100 causes the processing to be moved to step S11. Here, in a case where step S11 is performed after step S15 is performed, the controlled transport amount Fc based on the transport error ΔF calculated in step S14 is set.

Specifically, the current controlled transport amount Fc is larger than the previous controlled transport amount Fc, in a case where the actual transport amount Fr is smaller than the target transport amount Ft, that is, the transport error ΔF is larger than "0 (zero)", when the transport operation is performed based on the previous controlled transport amount Fc. Also, the current controlled transport amount Fc is smaller than the previous controlled transport amount Fc, in a case where the actual transport amount Fr is larger than the target transport amount Ft, that is, the transport error ΔF is smaller than "0 (zero)", when the transport operation is performed based on the previous controlled transport amount Fc.

As an example, the current controlled transport amount Fc may be the sum of the value which is obtained by multiplying a predetermined coefficient and the transport error ΔF obtained by performing the previous transport operation and the previous controlled transport amount Fc. Thus, in the present embodiment, the controlled transport amount Fc is changed during an N+1-th and the subsequent times of the transport operation based on the transport error ΔF generated during the N-th transport operation. The transport error ΔF in the present embodiment is not regarding the transport error suddenly generated, and is regarding the transport error regularly generated, for example, due to eccentricity of the transport roller 31, wear of the transport roller 31, or the like.

Next, the processing for performing the transport operation of step S12 will be described with reference to FIG. 7.

Figure 7:
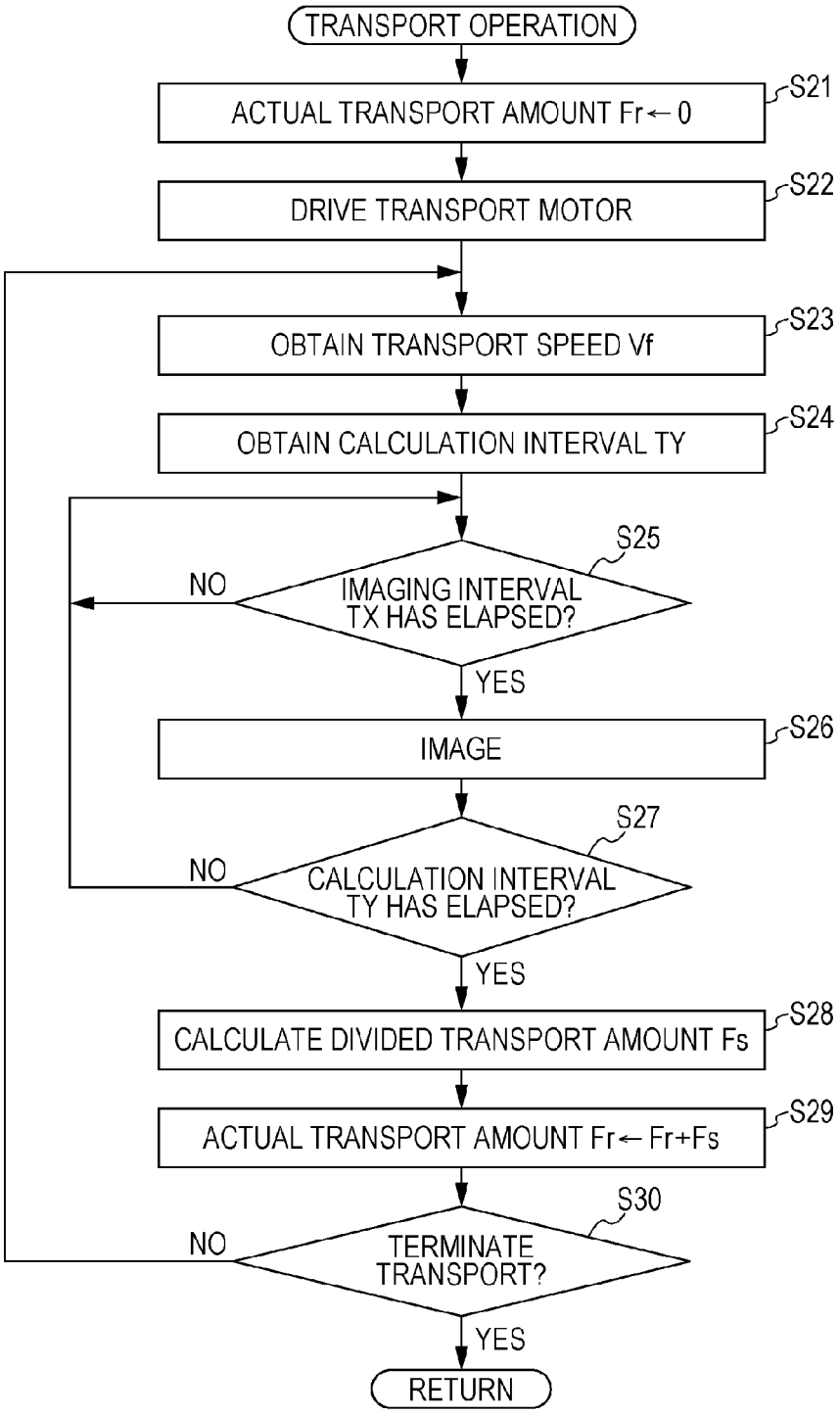
FIG. 7 is a flow chart illustrating a processing routine performed by the control unit in order to perform transport operation.

As illustrated in FIG. 7, in the present processing routine, the control unit 100 sets "0 (zero)" to the actual transport amount Fr (step S21), and then drives the transport motor 33 in order to transport the medium M (step S22). Here, the transport motor 33 is controlled to include a period in which the rotation speed corresponding to the acceleration period TA is gradually increased, a period in which the rotation speed corresponding to the constant speed period TB is maintained, and a period in which the rotation speed according to the deceleration period TC is decreased. In addition, the length of the period in which the rotation speed is maintained is changed based on the controlled transport amount Fc set in step S11.

Subsequently, the control unit 100 causes the transport speed Vf to be obtained according to the rotation speed of the transport motor 33 obtained based on the detection result of the rotary encoder 34 (step S23). Then, with reference to the map illustrated in FIG. 5, the control unit 100 causes the calculation interval TY to be obtained based on the transport speed Vf obtained in step S23 (step S24).

Subsequently, the control unit 100 determines whether the imaging interval TX has elapsed or not (step S25), and in a case where the imaging interval TX does not elapse (step S25: NO), step S25 is performed again. On the other hand, in a case where the imaging interval TX has elapsed (step S25: YES), the control unit 100 causes the imaging unit 50 to image the medium M (step S26). The image 200 captured by the imaging unit 50 is stored to a RAM constituting the control unit 100.

Then, the control unit 100 determines whether the calculation interval TY has elapsed or not (step S27), and in a case where the calculation interval TY does not elapse (step S27: NO), the control unit 100 causes the processing to be moved to the previous step S25. In other words, in this case, the medium M is captured without the divided transport amount Fs being calculated. On the other hand, in a case where the calculation interval TY has elapsed (step S27: YES), the divided transport amount Fs is calculated based on the image 200 captured by the imaging unit 50, by the control unit 100 (step S28).

Here, the divided transport amount Fs is calculated based on the two images 200 (the previous image and the current image) described above. However, the previous image when the divided transport amount Fs is calculated is set to the image 200 captured first by the imaging unit 50, in a case where step S28 is performed for the first time from the start of the processing routine. On the other hand, in a case where step S28 is performed from the start of the present processing routine in the two and subsequent times, the previous image when the divided transport amount Fs is calculated is set to the current image when the previous step S28 is performed. The current image when the divided transport amount Fs is calculated is set to the image 200 captured by performing the most recent step S26.

For example, in a case where the calculation interval TY is equal to the imaging interval TX, the divided transport amount Fs is calculated based on the N-th image 200 and the N+1-th image 200, among the images 200 captured continuously. The next divided transport amount Fs is calculated based on the N+1-th image 200 and the N+2-th image 200. In other words, in this case, the images 200 captured continuously are used in calculation of the divided transport amount Fs.

In a case where the calculation interval TY is equal to twice the imaging interval TX, the divided transport amount Fs is calculated based on the N-th image 200 and the N+2-th image 200, among images 200 continuously captured. Also, the next divided transport amount Fs is calculated based on the N+2-th image 200 and the N+4-th image 200. In other words, in this case, the N+1-th image 200 and the N+3-th image 200 are not used in calculation of the divided transport amount Fs.

Then, by the control unit 100, the divided transport amount Fs is added to the actual transport amount Fr (step S29) and then whether the transport of the medium M is terminated or not is determined (step S30). Whether the transport of the medium M is terminated or not may be determined by whether the rotation amount of the transport motor 33 reaches the rotation amount according to the controlled transport amount Fc. In a case where the transport of the medium M is terminated (step S30: YES), the control unit 100 causes the present processing routine to be temporarily terminated after the drive of the transport motor 33 is stopped. On the other hand, in a case where the transport operation is not terminated (step S30: NO), the control unit 100 causes the processing to be moved to the previous step S23.

According to the processing routine, while repeatedly performing the processing of steps S25 to S27 by the negative determination in step S27, the calculation interval TY used in the determination of step S27 is not changed even though the transport speed Vf is changed.

Next, with reference to the timing chart illustrated in FIGS. 8A to 8D, the operation when the printing apparatus 10 according to the embodiment performs the printing on the medium M will be described. In the timing chart in FIGS. 8A to 8D, the transport operation started from a first timing t21 is referred to as an N-th transport operation and the transport operation started from the fourteenth timing t34 is referred to as an N+1-th transport operation. In order to easily understand the description, the first calculation interval TY1 is set to "1 times" the imaging interval TX, the second calculation interval TY2 is set to "2 times" the imaging interval TX, and the third calculation interval TY3 is set to "3 times" the imaging interval TX.

As illustrated in FIGS. 8A, 8B, 8C, and 8D, the N-th transport operation is started at the first timing t21. Since the transport speed Vf is less than the first determination speed Vf1 at the first timing t21, the calculation interval TY is set to the third calculation interval TY3 (=3·TX). In the present embodiment, since the imaging interval TX is an equal time interval regardless of the transport speed Vf, the medium M is captured at each imaging interval TX after the first timing t21.

Then, at a second timing t22 in which the time elapsed from the first timing t21 is greater than or equal to the third calculation interval TY3, the divided transport amount Fs during the period from the first timing t21 to the second timing t22 is calculated. Specifically, the divided transport amount Fs during the period is calculated based on the image 200 captured at the first timing t21 and the image 200 captured at the subsequent second timing t22. Therefore, two images 200 captured between the first timing t21 and the second timing t22 are not used in calculation of the divided transport amount Fs during the period.

Since the transport speed Vf is greater than or equal to the first determination speed Vf1 at the second timing t22, the calculation interval TY is set to the second calculation interval TY2 (=2·TX) after the second timing t22. In other words, since the transport speed Vf becomes higher after the second timing t22 than before the second timing t22, the calculation interval TY is decreased.

Then, at a third timing t23 in which the time elapsed from the second timing t22 is greater than or equal to the second calculation interval TY2, the divided transport amount Fs during the period from the second timing t22 to the third timing t23 is calculated. Specifically, the divided transport amount Fs during the period is calculated, based on the image 200 captured at the second timing t22, and the image 200 captured at the subsequent third timing t23. Therefore, one image 200 captured between the second timing t22 and the third timing t23 is not used in calculation of the divided transport amount Fs during the period.

At a fourth timing t24, since the transport speed Vf is greater than or equal to the second determination speed Vf2, the calculation interval TY is set to the first calculation interval TY1(=TX) after the fourth timing t24. In other words, since the transport speed Vf becomes higher after the fourth timing t24 than before the fourth timing t24, the calculation interval TY is more decreased. Subsequently, at a fifth timing t25 in which the transport speed Vf is the maximum speed Vfm, it is changed from the acceleration period TA to the constant speed period TB.

Then, at a sixth timing t26 in which the time elapsed from the third timing t23 is greater than or equal to the second calculation interval TY2, the divided transport amount Fs during the period from the third timing t23 to the sixth timing t26 is calculated. Specially, the divided transport amount Fs during the period is calculated based on the image 200 captured at the third timing t23 and the image 200 captured at the subsequent sixth timing t26.

Subsequently, at a seventh timing t27 in which the time elapsed from the sixth timing t26 is greater than or equal to the first calculation interval TY1, the divided transport amount Fs during the period from the sixth timing t26 to the seventh timing t27 is calculated. Specially, the divided transport amount Fs during the period is calculated based on the image 200 captured at the sixth timing t26 and the image 200 captured at the subsequent seventh timing t27. Therefore, the divided transport amount Fs during the period is calculated based on the images 200 captured continuously, and all the images 200 are used in calculation of the divided transport amount Fs in the period.

Then, at an eighth timing t28, it is changed from the constant speed period TB into the deceleration period TC. In addition, the divided transport amount Fs is calculated at the first calculation interval TY1 equal to the imaging interval TX, during the period from the seventh timing t27 to the eighth timing t28.

Subsequently, at a ninth timing t29, since the transport speed Vf is set to less than the second determination speed Vf2, the calculation interval TY is set to the second calculation interval TY2 (=2·TX). In other words, since the transport speed Vf is lower after the ninth timing t29 than before the ninth timing t29, the calculation interval TY is increased. Then, after the ninth timing t29, at a eleventh timing t31 in which the time elapsed from a tenth timing t30 at which the calculation of the divided transport amount Fs is first performed is the second calculation interval TY2, the divided transport amount Fs during the period from the tenth timing t30 to the eleventh timing t31 is calculated. Specifically, the divided transport amount Fs during the period is calculated based on the image 200 captured at the tenth timing t30 and the image 200 captured at the subsequent eleventh timing t31. Therefore, one image 200 captured between the tenth timing t30 and the eleventh timing t31 is not used in calculation of the divided transport amount Fs during the period.

The eleventh timing t31 is a timing in which the transport speed Vf is less than the first determination speed Vf1 and is a timing during the deceleration period TC. Therefore, the calculation interval TY is set to the first calculation interval TY1 (=TX) after the eleventh timing t31, as illustrated by the broken line in FIG. 5.

Subsequently, the divided transport amount Fs during the period from the eleventh timing t31 to a twelfth timing t32 is calculated at the twelfth timing t32 in which the time elapsed from the eleventh timing t31 is greater than or equal to the first calculation interval TY1. Therefore, the transport of the medium M is stopped at a thirteenth timing t33, and then it is changed from the deceleration period TC to the stopping period TS. In the period from the twelfth timing t32 to the thirteenth timing t33, the divided transport amount Fs is calculated at the first calculation interval TY1.

The calculation interval TY (TY1) during the period from the eleventh timing t31 to the thirteenth timing t33 during the deceleration period TC is shorter than the calculation interval TY (TY2) during the period from the ninth timing t29 to the eleventh timing t31 during the deceleration period TC. At this point, in the present embodiment, the period from the ninth timing t29 to the eleventh timing t31 corresponds to the first deceleration period TC1" and the period from the eleventh timing t31 to the thirteenth timing t33 corresponds to the second deceleration period TC2".

Thus, in the present embodiment, except for the second deceleration period TC2, the calculation interval TY of the divided transport amount Fs is increased as the transport speed Vf is decreased. Therefore, even though the transport speed Vf is low, the number of calculations of the divided transport amount Fs is prevented from being increased and the calculation accuracy of the actual transport amount Fr calculated by integration of the divided transport amount Fs is prevented from being reduced. In the second deceleration period TC2, by increasing the number of calculations of the divided transport amount Fs, the calculation accuracy of the actual transport amount Fr is prevented from being reduced without obtaining the divided transport amount Fs immediately before stopping of the medium M.

The N-th discharging operation corresponding to the N-th transport operation is performed after the thirteenth timing t33. Then, the N+1-th transport operation is performed after the fourteenth timing t34 in which the N-th discharging operation is terminated. Specifically, the acceleration period TA is started in the fourteenth timing t34, the constant speed period TB is started at a fifteenth timing t35, the deceleration period TC is started at a sixteenth timing t36, and the stopping period TS is started at a seventeenth timing t37.

Figure 8:
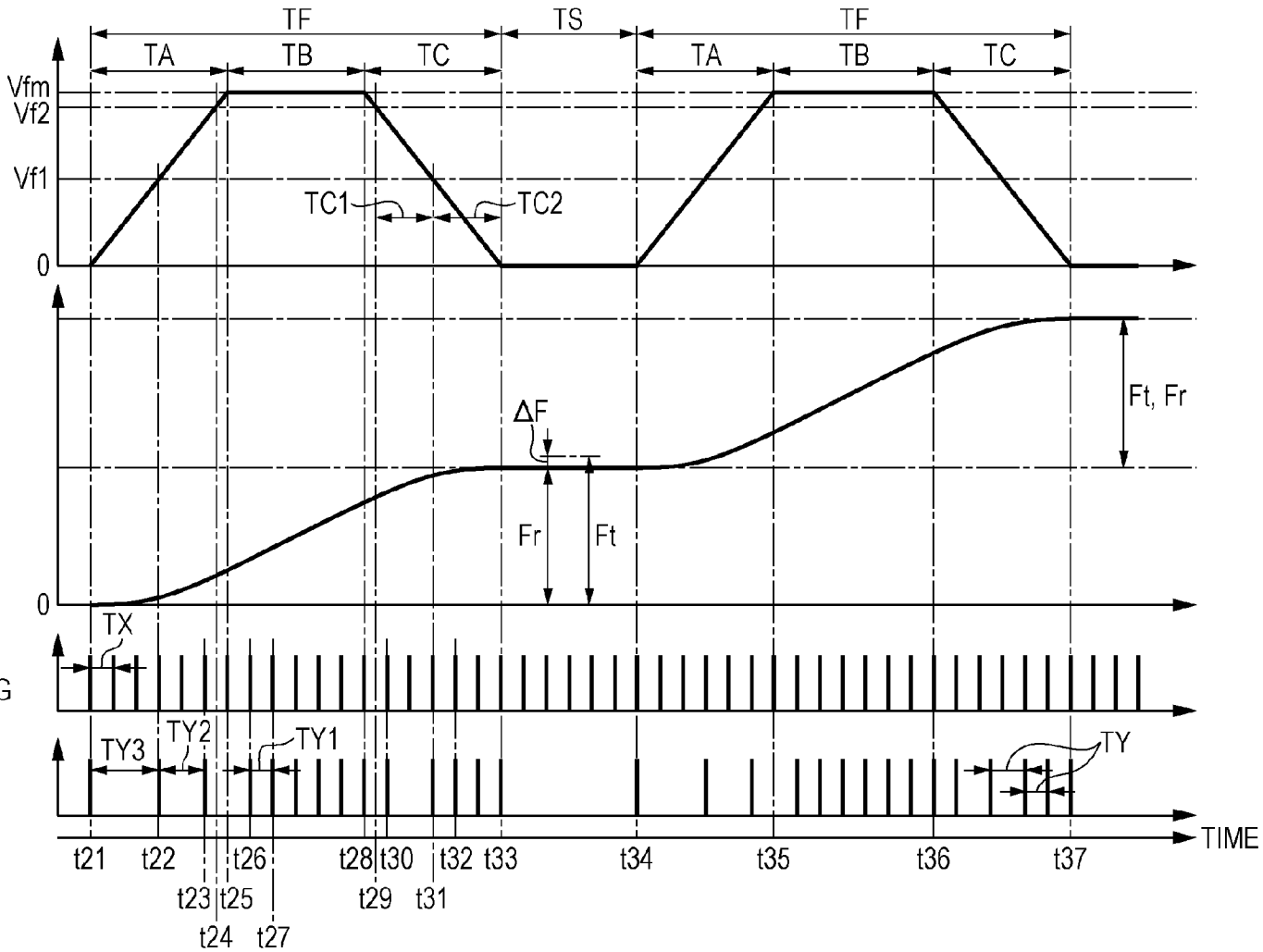
FIG. 8A is a timing chart illustrating transition of a transport speed.
FIG. 8B is a timing chart illustrating transition of transport amounts.
FIG. 8C is a timing chart illustrating transition of an imaging timing.
FIG. 8D is a timing chart illustrating transition of a calculation timing of divided transport amounts, when performing printing on a medium.

Here, as illustrated in FIG. 8B, in a case where the actual transport amount Fr and the target transport amount Ft are different from each other at the thirteenth timing t33 in which the N-th transport operation is terminated, the controlled transport amount Fc in the N+1-th transport operation is changed based on the transport error ΔF which is a difference obtained by subtracting the actual transport amount Fr from the target transport amount Ft. In other words, as illustrated in FIG. 8B, in the case where the transport error ΔF in the N-th transport operation is greater than or equal to "0 (zero)", the controlled transport amount Fc is increased in the N+1-th transport operation. As a result, the constant speed period TB in the N+1-th transport operation is longer than the constant speed period TB in the N-th transport operation.

Therefore, as illustrated in FIG. 8B, the difference between the actual transport amount Fr and the target transport amount Ft is decreased at the seventeenth timing t37 in which the N+1-th transport operation is terminated. Thus, according to the embodiment, the transport error ΔF is calculated in the N-th transport operation based on the image 200 captured by the imaging unit 50, and the transport error ΔF is decreased after the N+1 transport operation based on the transport error ΔF.

According to the embodiment described above, it is possible to obtain the effect described below.

(1) The calculation interval TY is longer in a case where the transport speed Vf is low than in a case where the transport speed Vf is high. Therefore, the number of calculations of the divided transport amount Fs is decreased more in a case where the transport speed Vf is low than when the calculation interval TY is an equal interval. Thus, according to the configuration, it is possible to prevent the calculation accuracy of the actual transport amount Fr from being reduced.

(2) Since the calculation interval TY during the second deceleration period TC2 is shorter than the calculation interval TY during the first deceleration period TC1, it is possible to calculate the divided transport amount Fs during the period immediately before the transport of the medium M is stopped in detail. On the other hand, if the calculation interval TY during the first deceleration period TC1 in addition to the second deceleration period TC2 is decreased, the calculation error is likely to affect the calculation accuracy of the actual transport amount Fr. Therefore, according to the configuration, it is possible to prevent the calculation accuracy of the actual transport amount Fr from being reduced and to calculate the divided transport amount Fs immediately before the medium M is stopped in detail.

(3) In a case where the transport speed Vf is low, since a portion of the image 200 captured by the imaging unit 50 is not used in calculation of the divided transport amount Fs, the calculation interval TY is increased. Therefore, since there is no need to perform control for changing the imaging interval TX of the imaging unit 50, it is possible to prevent the control configuration from being complicated and to prevent the calculation accuracy of the actual transport amount Fr from being reduced.

(4) Since the controlled transport amount Fc is changed after the N+1-th transport operation based on the transport error ΔF in the N-th transport operation, the transport error ΔF after the N+1-th transport operation can be reduced.

The embodiment described above may be changed as below.

The control unit 100 may cause the imaging interval TX to be longer by increasing the imaging interval TX of the imaging unit 50 in a case where the transport speed Vf is low than in a case where the transport speed Vf is high.

Figure 9:
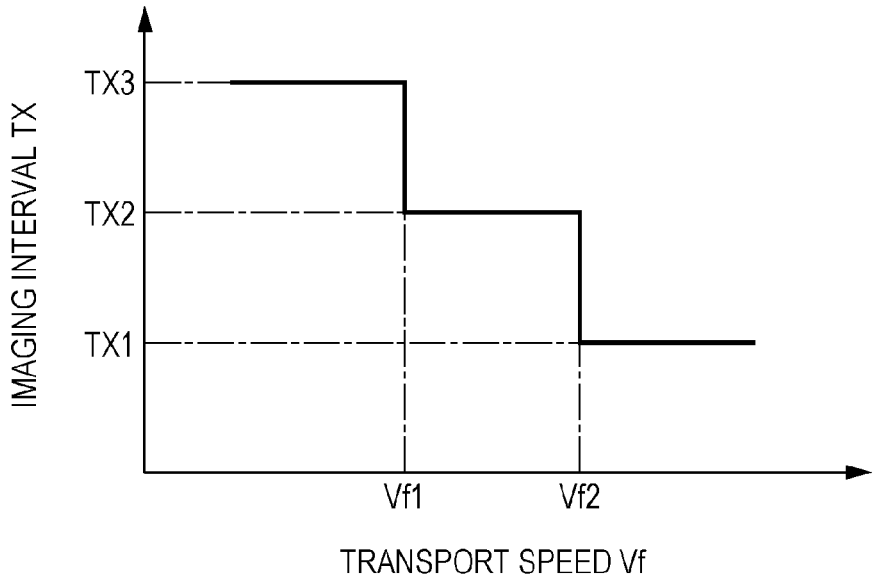
FIG. 9 is a view illustrating a map for determining a calculation interval according to the transport speed in another embodiment.

In other words, as illustrated in FIG. 9, in a case where the transport speed Vf is less than the first determination speed Vf1, the imaging interval TX is set to the third imaging interval TX3. In addition, in a case where the transport speed Vf is greater than or equal to the first determination speed Vf1 and is less than the second determination speed Vf2 which is greater than the first determination speed Vf1, the imaging interval TX is set to the second imaging interval TX2 which is smaller than the third imaging interval TX3. Then, in a case where the transport speed Vf is greater than or equal to the second determination speed Vf2, the imaging interval TX is set to the first imaging interval TX1 which is smaller than the second imaging interval TX2.

Figure 10:
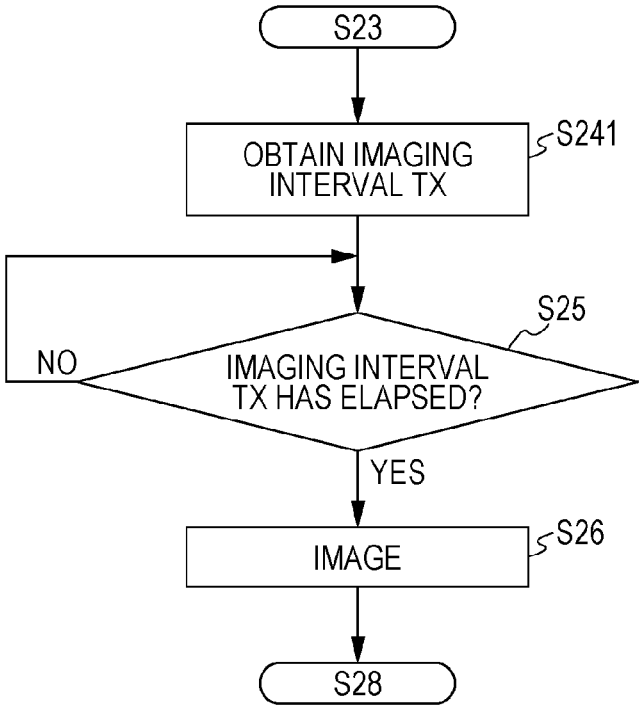
FIG. 10 is a flow chart illustrating a processing routine performed by the control unit in order to perform transport operation in another embodiment.

Then, as illustrated in FIG. 10, the control unit 100 causes the imaging interval TX to be obtained based on the transport speed Vf obtained in step S23 (step S241), with reference to the map illustrated in FIG. 9. Subsequently, the control unit 100 determines whether the imaging interval TX has elapsed or not (step S25), and in a case where the imaging interval TX has elapsed (step S25: YES), the medium M is captured by the imaging unit 50.

Then, the divided transport amount Fs is calculated based on the image 200 captured by performing the current step S26, and the image 200 captured by performing the previous step S26 (step S28), and the processing is moved to step S29. According to the processing routine, all the images 200 captured by the imaging unit 50 are used in calculation of the divided transport amount Fs.

According to this, the imaging interval TX is longer in a case where the transport speed Vf is low than in a case where the transport speed Vf is high. As a result, the calculation interval TY is increased. Consequently, it is possible to prevent the calculation accuracy of the actual transport amount Fr from being reduced.

Figure 11:
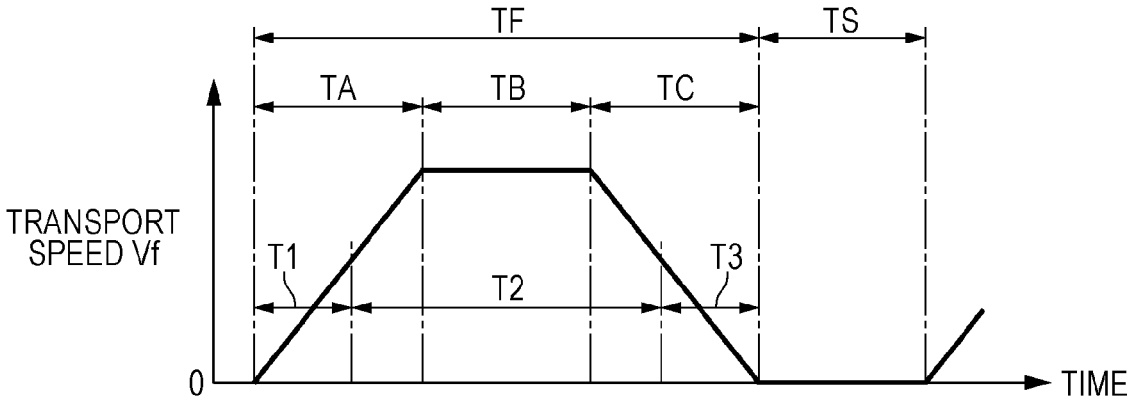
FIG. 11 is a timing chart illustrating a timing to change a calculation interval in another embodiment.

As illustrated in FIG. 11, the calculation interval TY in at least one period of the first period T1 including the acceleration period TA and the third period T3 including the deceleration period TC may be longer than the calculation interval TY in the second period T2 which is the period between the first period T1 and the third period T3.

Since the first period T1 includes the acceleration period TA, the transport speed Vf in the first period T1 is likely to be lower than the transport speed Vf in the second period T2. Since the third period T3 includes the deceleration period TC, the transport speed Vf in the third period T3 is likely to be lower than the transport speed Vf in the second period T2. According to this, since the calculation interval TY in at least one period of the first period T1 and the third period T3 is longer than the calculation interval TY in the second period T2, it is possible for the calculation interval TY to be longer as the transport speed Vf is reduced, without grasping the transport speed Vf by the control unit 100. Therefore, it is possible to prevent the control configuration from being complicated.

In addition, simply, the calculation interval TY in at least one of the acceleration period TA and the deceleration period TC may be longer than the calculation interval TY in the constant speed period TB. Even with the configuration, since the control unit 100 does not need to grasp the transport speed Vf, it is possible to prevent the control configuration from being complicated and to prevent the complication accuracy of the actual transport amount Fr from being reduced.

After the drive of the transport roller 31 is stopped and before the discharging operation is performed, the medium M is moved in the transport direction D. For example, after the drive of the transport roller 31 is stopped, the medium M slides in the transport direction D on the supporting unit 40. Therefore, in this case, the calculation of the divided transport amount Fs is performed after the drive of the transport roller 31 is stopped, and the divided transport amount Fs may be integrated into the actual transport amount Fr. According to this, the controlled transport amount Fc during the next transport operation can be determined based on a movement amount of the medium M after the drive of the transport roller 31 is stopped, it is possible for the transport error ΔF to be further decreased.

According to the embodiment, as illustrated in FIG. 5, the map for obtaining the calculation interval TY in the deceleration period TC is different from the map for obtaining the calculation interval TY in the acceleration period TA. However, the map for obtaining the calculation interval TY in the deceleration period TC and the map for obtaining the calculation interval TY in the acceleration period TA may be the same as each other. In other words, the calculation interval TY in the deceleration period TC may be obtained based on the map illustrated by the solid line in FIG. 5.

In the embodiment, as illustrated in FIG. 5, the calculation interval TY is changed based on a timing in which the transport speed Vf is greater than or equal to the determination speeds Vf1 and Vf2 and a timing in which the transport speed Vf is less than the determination speeds Vf1 and Vf2. However, the calculation interval TY may be changed at other timings. For example, the calculation interval TY may be changed at a timing in which the transport amount of the medium M is greater than or equal to a predetermined transport amount determination value. In addition, in a case where the transport acceleration of the medium M is shifted in a stepwise manner in the acceleration period TA, or the transport deceleration of the medium M is shifted in a stepwise manner in the deceleration period TC, the calculation interval TY may be changed at a timing in which the transport acceleration and the transport deceleration are shifted.

In FIG. 5, the calculation interval TY is changed in three stages according to the transport speed Vf. However, the calculation interval TY may be changed in other stages according to the transport speed Vf. Also, the calculation interval TY may be changed in a stepless manner according to the transport speed Vf. In the latter case, a relationship between the transport speed Vf and the calculation interval TY may be linear or nonlinear. In addition, the same is applied to the imaging interval TX illustrated in FIG. 9.

In the flow chart illustrated in FIG. 7, the control of the transport roller 31 and the control of the imaging unit 50 are performed by a single control unit 100. However, the control unit 100 that performs the control of the transport unit 30 and the control unit 100 that performs the control of the imaging unit 50 may be provided separately.

According to the embodiment, the transport control in which the transport error ΔF generated by the N-th transport operation is reflected in the transport amount Fc in the N+1-th transport operation is performed. However, other transport controls may be performed. For example, the transport control in which, in the middle of the N-th transport operation, the transport error ΔF is calculated based on the actual transport amount Fr until then and the transport error ΔF until the N-th transport operation is terminated is reflected in the N-th controlled transport amount Fc may be performed. In addition, after the N-th transport operation is terminated, before the N-th discharging operation is started, a preliminary transport operation may be performed for eliminating the transport error ΔF generated by the N-th transport operation.

The constant speed period TB may not be included in the transport period TF. In other words, the acceleration period TA and the deceleration period TC may only constitute the transport period TF.

In addition, a duration period of the acceleration period TA, the constant speed period TB and the deceleration period TC or the transport aspects during the transport period TF which is referred to as the transport acceleration of the acceleration period TA and the transport deceleration of the deceleration period TC may be optionally changed. For example, depending on the type of the medium M, there is a case where the medium M is likely to be slid on the supporting unit 40 and to be moved when the medium M is transported. Then, in this case, the transport aspects may be changed depending on the type of the medium M. For example, as the medium M is likely to be slid on the supporting unit 40, the transport acceleration of the acceleration period TA and the transport deceleration of the deceleration period TC may be decreased.

According to the embodiment, in a case where an example of the medium M is paper, the pattern 201 may have a shape in which, fiber or the like constituting paper is intertwined. For example, if the pattern 201 can be regarded as a feature in a specific region, the pattern may be formed intentionally at the time of the manufacture of the medium M, for example.

The transport device may be applied to a device other than the printing apparatus 10. For example, the transport device may be applied to a machining device that performs machining to a workpiece (one example of the medium M) which is transported.

If the printing apparatus repeats the transport operation and the discharging operation, the printing unit 60 does not include the carriage 62. Also, the printing apparatus may be changed to the so-called full line type of printing apparatus including an elongated and fixed discharging head (a line head) corresponding to the entire width of the medium M.

A recording material to be used in the printing may be fluid other than ink (including liquid, liquid material in which particles of the functional material are dispersed or mixed in the liquid, fluid material such as a gel, or a solid which can be ejected as a fluid). For example, the recording material may be configured to perform recording by ejecting the liquid material including material in the dispersed or dissolved form of an electrode material, a color material (a pixel material) or the like which is used in manufacturing a liquid crystal display, an electroluminescence (EL) display and a surface emitting display.

In addition, the printing apparatus 10 may be a fluid material ejecting device which ejects a fluid material such as gel (for example, physical gel), and a particulate ejecting device (for example, a toner jet recording device) which ejects a solid, for example, powder (particulate) such as toner. The term "fluid" as used in the present specification is a concept that does not include a fluid which is composed of only a gas. For example, the fluid includes a liquid (including inorganic solvents, organic solvents, solutions, liquid resins, liquid metals (metal melt), or the like), a liquid material, a fluid material, and a particulate (including particle, powder).

The printing apparatus 10 is not limited to a printer which performs recording by ejecting a fluid such as ink. For example, the printing apparatus may be a non-impact printer such as a laser printer, an LED printer, a thermal transfer printer (including a sublimation printer), and an impact printer such as a dot impact printer.

The entire disclosure of Japanese Patent Application No. 2015-114280, filed Jun. 4, 2015 is expressly incorporated by reference herein.

What is claimed is:

1. A transport device comprising:

a transport unit that intermittently transports a medium;

an imaging unit that images the medium transported by the transport unit; and a control unit that calculates a transport amount during a transport period from start of the medium transport to stop of the medium transport based on a captured image of the medium by the imaging unit and controls the transport unit, wherein the control unit calculates the transport amount during the transport period by calculating a divided transport amount at each divided period which is obtained by dividing the transport period into a plurality of periods and integrating the divided transport amount at each divided period, and causes the divided period to be longer in a case where a transport speed of the medium is low than in a case where the transport speed of the medium is high.

2. The transport device according to claim 1,

Wherein the transport period includes a first period including an acceleration period during which the medium is transported while accelerating the medium, a second period following the first period, and a third period following the second period and including a deceleration period during which the medium is transported while decelerating the medium, and wherein the control unit causes the divided period during at least one period of the first period and the third period to be longer than that during the second period.

3. The transport device according to claim 1,

Wherein the transport period includes a deceleration period during which the medium is transported while decelerating the medium, wherein the deceleration period includes a first deceleration period, and a second deceleration period which follows the first deceleration period and is terminated at a timing when the medium is stopped, and wherein the control unit causes the divided period during the second deceleration period to be shorter than that during the first deceleration period.

4. The transport device according to claim 1, wherein the control unit causes the divided period to be longer in a case where the transport speed is low more than in a case where the transport speed is high by increasing an imaging interval of the imaging unit.

5. The transport device according to claim 1, wherein the imaging unit images the medium at an equal imaging interval, and wherein the control unit causes the divided period to be longer in a case where the transport speed is low than in a case where the transport speed is high, by, among two images used when the divided transport amount is calculated, selecting the other image so that the period elapsed from when one image is captured to when the other image is captured is increased.

6. A printing apparatus comprising:

a transport device that transports a medium; and a printing unit that prints on the medium which is transported by the transport device, and wherein the printing apparatus includes the transport device according to claim 1 as the transport device.

7. A printing apparatus comprising:

a transport device that transports a medium; and a printing unit that prints on the medium which is transported by the transport device, and wherein the printing apparatus includes the transport device according to claim 2 as the transport device.

8. A printing apparatus comprising:

a transport device that transports a medium; and a printing unit that prints on the medium which is transported by the transport device, and wherein the printing apparatus includes the transport device according to claim 3 as the transport device.

9. A printing apparatus comprising:

a transport device that transports a medium; and a printing unit that prints on the medium which is transported by the transport device, and wherein the printing apparatus includes the transport device according to claim 4 as the transport device.

10. A printing apparatus comprising:

a transport device that transports a medium; and a printing unit that prints on the medium which is transported by the transport device, and wherein the printing apparatus includes the transport device according to claim 5 as the transport device.

* * * * *